US005153396A

United States Patent [19]

Cummings

[11] Patent Number: 5,153,396

[45] Date of Patent: Oct. 6, 1992

[54] COMBINATION HIGH PRESSURE SWITCH AND VALVE DEVICE

[75] Inventor: Larry D. Cummings, Clarence, N.Y.

[73] Assignee: General Motors Corporation, Detroit, Mich.

[21] Appl. No.: 670,560

[22] Filed: Mar. 18, 1991

[51] Int. Cl.[5] ..... H01H 35/34

[52] U.S. Cl. ..... 200/83 Q; 200/83 J; 200/83 W; 200/306; 200/61.08; 439/158; 439/197

[58] Field of Search ..... 62/228.1, 228.3; 91/1; 92/5 R; 307/118; 73/861.47, 717, 723; 417/44; 340/611, 626; 439/132, 152, 154, 158, 197; 200/81 R, 81.4, 81.5, 83 R, 83 P, 83 J, 83 D, 83 W, 302.1, 306, 51.09, 61.08

[56] References Cited

U.S. PATENT DOCUMENTS

| | | | |
|---|---|---|---|
| 4,117,287 | 9/1978 | Walker | 200/82 R |
| 4,133,186 | 1/1979 | Brucken et al. | 62/228 |
| 4,400,601 | 8/1983 | Brucken | 200/81.4 |
| 4,469,923 | 9/1984 | Charboneau | 200/83 P |
| 4,669,791 | 6/1987 | Savill | 439/132 |
| 4,859,196 | 8/1989 | Durando | 439/197 |
| 4,948,931 | 8/1990 | Nixon | 200/83 P |

FOREIGN PATENT DOCUMENTS

| | | | |
|---|---|---|---|
| 0741355 | 6/1980 | U.S.S.R. | 439/158 |
| 0957324 | 9/1982 | U.S.S.R. | 439/197 |

*Primary Examiner*—Gerald P. Tolin

[57] ABSTRACT

A combination high pressure relief valve/high pressure cut-off device includes a housing for mounting in a pressure control installation. A high pressure switch, biased to a closed position, is mounted in this housing. A force transmitting mechanism is also mounted in the housing. The force transmitting mechanism includes a pressure sensing diaphragm adapted to be exposed to the pressure to be sensed. The force transmitting mechanism is responsive to pressure above a predetermined lower threshold pressure value to open the high pressure switch. The device also provides for rupturing the pressure sensing diaphragm so as to provide extreme high pressure relief in the event pressures build above a predetermined upper threshold high pressure value substantially higher. Additionally, the device may be electrically connected by means of a blow-off connector. The blow-off connector includes a resilient latch adapted to remain locked and retain the connector in position under normal operating conditions. The latch, however, releases and allows the connector to blow-off at or about the upper threshold pressure.

3 Claims, 2 Drawing Sheets

COMBINATION HIGH PRESSURE SWITCH AND VALVE DEVICE

TECHNICAL FIELD

The present invention relates generally to a combination switch and valve device and, more particularly, to a combination high-pressure cut-off switch/high-pressure relief valve device for pressure control, such as for a compressor of an automotive air conditioning system.

BACKGROUND OF THE INVENTION

Automotive air conditioning systems employ a compressor that is driven by the engine through an electromagnetic clutch. In practice, it is common to provide some form of clutch switching and pressure relief to protect the system from extreme high pressure. For example, it is desirable that the compressor not operate above a certain high pressure (for example, 550 psig), since pressures above this extreme may adversely affect compressor and/or other components life. It is further desirable that the high pressure relief, normally involving venting to atmosphere, be provided as secondary rather than primary protection against high pressure. Accordingly, various clutch switching and pressure relief arrangements have been proposed to satisfy these requirements. An example of one of the more sophisticated and successful devices for this purpose is disclosed in U.S. Pat. No. 4,400,601 to Brucken assigned to General Motors Corporation.

The device disclosed in the Brucken patent is an integrated unit including an electrically conductive housing adapted to be electrically grounded on mounting in the compressor cylinder head. The device actually includes both low pressure and high pressure switches that are operatively electrically connected in series for adaptation in a control circuit. Under normal or acceptable operating pressures, both the low pressure and high pressure switches are biased to a normally closed position. In the event the pressure falls above or below the normal operating pressure range, either the low pressure or high pressure switch opens so as to open the circuit and disengage the electromagnetic clutch, thereby terminating compressor operation.

The device also includes a high pressure relief valve. This valve is normally biased closed and is responsive to a predetermined extreme high pressure value substantially higher than the pressure value that opens the high pressure relief switch. Consequently, the high pressure relief valve serves as a secondary high pressure protection and operates where for some reason pressure in the system continues to rise after the clutch is disengaged.

While the combination cut-off switch/relief valve device disclosed in the Brucken patent represented a significant advance in the art at the time of its development, further improvement remains a goal. In particular, while the device represented a successful structure at the time of its development, it includes a relatively large number of working parts. As such, a less complicated, simplified structure that is less expensive to manufacture is desired. A more reliable structure presenting a reduced number of potential leak pathways and increased overall operating efficiencies is also sought.

SUMMARY OF THE INVENTION

Accordingly, a primary object of the present invention is to provide a combination high pressure cut-off switch/high pressure relief valve device for mounting in a pressure control installation overcoming the above-described limitations and disadvantages of the prior art.

Another object of the present invention is to provide a combination high pressure cut-off switch/high pressure relief valve device of simplified structure that is not only less expensive to manufacture but also provides more reliable performance and an increased service life.

Yet another object of the invention is to provide a combination high pressure cut-off switch/high pressure relief valve device that reduces the number of potential leak passageways for more dependable operation even under the most severe operating conditions.

Still a further object of the invention is to provide a high pressure cut-off switch/high pressure relief valve device that operates with increased efficiency and increased accuracy in its relief pressure settings.

Additional objects, advantages and other novel features of the invention will be set forth in part in the description that follows and in part will become apparent to those skilled in the art upon examination of the following or may be learned with the practice of the invention. The objects and advantages of the invention may be realized and attained by means of the instrumentalities and combinations particularly pointed out in the appended claims.

To achieve the foregoing and other objects, and in accordance with the purposes of the present invention as described herein, an improved combination high pressure cut-off switch/high pressure relief valve device includes a housing adapted to be mounted in a pressure control installation, such as in the cylinder head of an automotive air conditioning system compressor. A high pressure switch is mounted in this housing. Means are also provided for urging the contacts of the high pressure switch to a normally closed position so as to provide an electrically conductive path for an electromagnetic clutch of the AC system. When so energized, the clutch is engaged so as to provide a drive path from the vehicle engine to the compressor of the air conditioning system.

A force transmitting mechanism is also mounted in the housing. This mechanism includes a pressure sensing means, in the form of a diaphragm adapted to be exposed to the refrigerant fluid pressure to be sensed. More particularly, the force transmitting mechanism is responsive to the pressure on the diaphragm. When the pressure exceeds a predetermined high pressure value, the force transmitting mechanism including a diaphgragm serves to open the contacts of the high pressure switch against the bias of a disc spring. As the contacts open, the electromagnetic clutch circuit is interrupted, thereby disengaging the clutch and shutting down the compressor. This is all that is normally required to reduce the refrigerant fluid pressure within the air conditioning system and thereby protect the compressor and the system from damaging high pressure.

In certain situations and under certain operating conditions, it is desired to provide additional, secondary high pressure or upper threshold protection. Accordingly, the present invention also provides means for rupturing the pressure sensing diaphragm. Preferably, rupturing at the upper threshold pressure only takes place in response to pressures at a predetermined very high pressure value, which is substantially higher than the lower threshold value at which the high pressure switch is opened.

In accordance with the broader aspects of the present invention, diaphragm rupturing means may take a number of forms. In accordance with one embodiment, a diaphragm material of very specific strength is selected. This material naturally ruptures or bursts at a reasonably fixed upper threshold value, for example, 550 psig, so as to provide venting to atmosphere and provide the extreme high pressure relief to the air conditioning system. In an alternative and more preferred embodiment, the rupturing means may take the form of one or more pins that are mounted to the housing in a position to engage and rupture the diaphragm. Either approach results in accurate threshold relief in the event the pressure within the system continues to rise for any reason following the opening of the high pressure switch. By selecting the particular diaphragm and related structure, the pressure at which the diaphragm is ruptured, and thus extreme high pressure relief, can be at any desired threshold level.

Once the diaphragm is ruptured, it is important for the high pressure refrigerant fluid to be rapidly discharged. Accordingly, passages are provided within the housing so as to provide an efficient path for the exhausting of the refrigerant fluid. In addition, a blow-off electrical connector is provided to operate in response to the release of the high pressure fluid. This connector normally serves to electrically connect the high pressure switch within the electromagnetic clutch circuit. Preferably, the connector includes a resilient latch adapted to remain locked and retain the connector in position under normal air conditioning system operating conditions. Upon rupturing of the diaphragm to provide high pressure relief, the passages serve to direct the refrigerant fluid under pressure to the connector. As the pressure builds, the holding force of the resilient latch is overcome and the connector is allowed to blow off. This results not only in venting of the refrigerant fluid to atmosphere or to an accumulator, but also provides a fail-safe interruption of electrical power to the compressor clutch. As this occurs, pressure within the system drops to a non-critical level, the compressor stops and potential damage due to the exceedingly high pressures at the upper threshold value is avoided.

Still other objects of the present invention will become readily apparent to those skilled in this art from the following description wherein there is shown and described a preferred embodiment of this invention, simply by way of illustration of one of the modes best suited to carry out the invention. As it will be realized, the invention is capable of other different embodiments, and its several details are capable of modifications in various, obvious aspects all without departing from the invention. Accordingly, the drawing and description will be regarded as illustrative in nature and not as restricted.

BRIEF DESCRIPTION OF THE DRAWING

The accompanying drawing incorporated in and forming a part of the specification illustrates several aspects of the present invention and together with the description serves to explain the principles of the invention. In the drawing.

Reference will now be made in detail to the present preferred embodiment of the invention, an example of which is illustrated in the accompanying drawing.

DETAILED DESCRIPTION OF THE INVENTION

Figure 1:
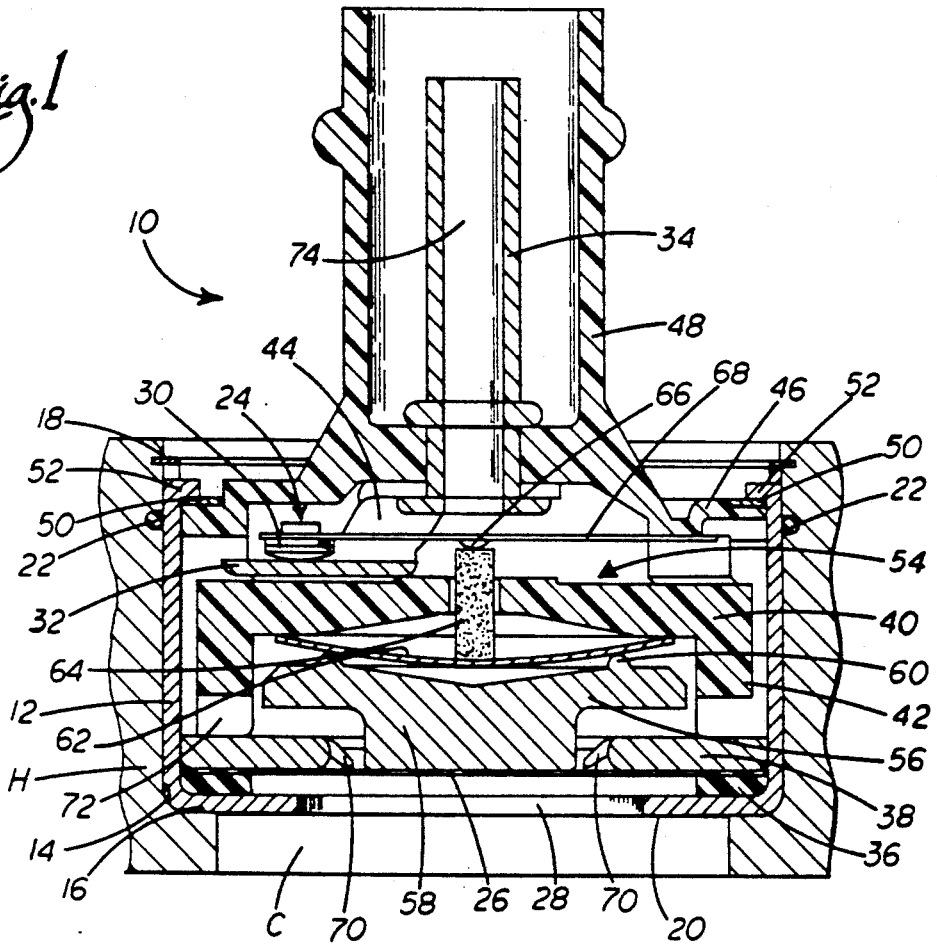
FIG. 1 is a partial cross-sectional view showing the combination high-pressure cut-off switch/high pressure relief valve device of the present invention mounted in a compressor cylinder head with the contacts closed so as to energize the electromagnetic clutch and engage the compressor.

Reference is now made to FIG. 1 showing an improved combination high pressure cut-off switch/high pressure relief valve device 10 that may be utilized to protect, for example, a compressor (not shown) of an automotive air conditioning system from operation at or above undesirably high threshold pressures. Such an automotive air conditioning system is disclosed in U.S. Pat. No. 4,133,186 entitled "Combined Electrical Cut-Off and Relief Valve", issued Jan. 9, 1979 and assigned to the assignee of the present invention and which is hereby incorporated by reference. The device 10 includes an electrically conductive housing 12. As shown, the housing 12 is cup shaped and is adapted to be electrically grounded on mounting in a pressure control installation, such as in the cylinder head H of the compressor. More specifically, the housing 12 closely fits in a counterbore 14 in the rear cylinder head H and is retained therein against a shoulder 16 by means of a retaining ring 18.

As should be appreciated, the housing 12 is exposed at its inner end 20 to a cavity C in the compressor which is exposed to the discharge pressure of the heat exchange or refrigerant fluid. An O-ring 22 received in a groove in the counterbore 14 engages the outer diameter of the housing 12 to seal the housing in the cylinder head 14 and prevent the leakage of refrigerant.

A high-pressure switch means 24 is mounted in the housing 12. As disclosed in the aforementioned U.S. Pat. No. 4,133,186, the high-pressure switch 24 is operatively electrically connected in a control circuit for the electromagnetic clutch (not shown) through which the compressor is driven by the vehicle's engine.

As shown in FIG. 1, the high-pressure switch 24 is normally biased closed, that is, with contact 30 and contact strip 32 in engagement. Thus, under normal operating conditions, the circuit is completed to energize the electromagnetic clutch and thereby provide operation of the compressor.

Figure 2:
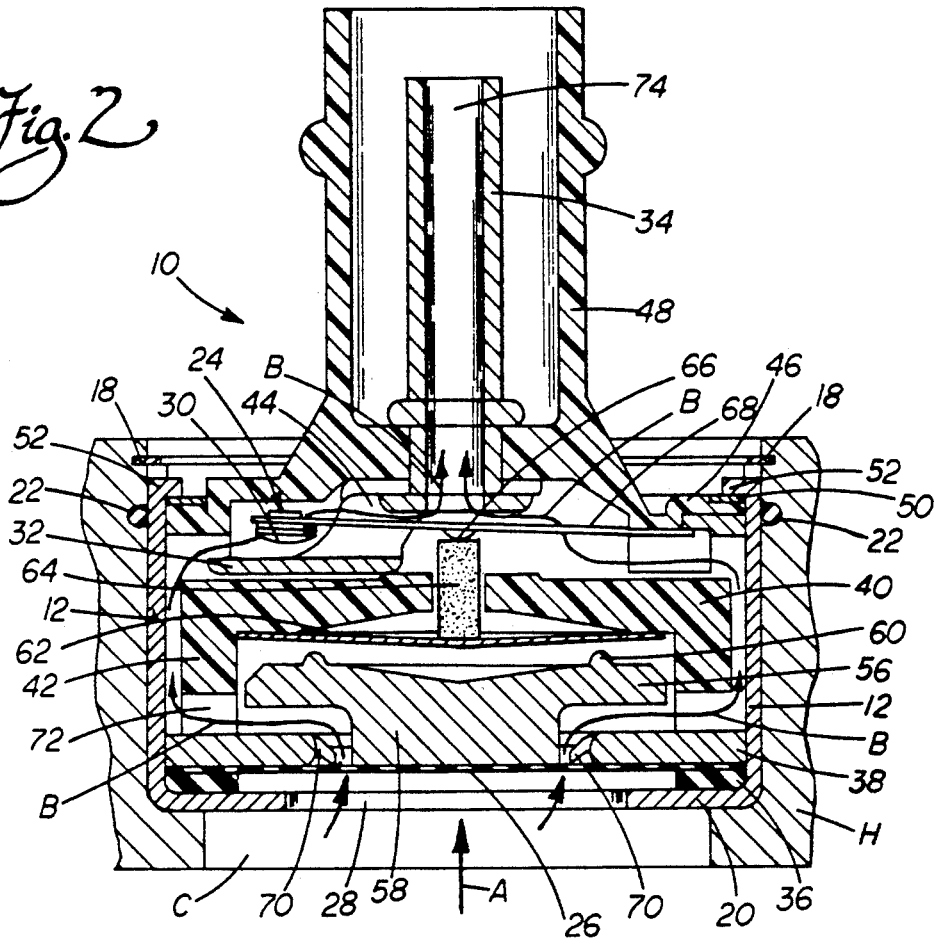
FIG. 2 is a view similar to FIG. 1 but at high threshold refrigerant pressure with the disc spring and actuator pin raised so as to open the contacts, thereby deenergizing the electromagnetic clutch and shutting down the compressor.

The high pressure switch 24 is responsive to pressure exerted on a pressure-sensing diaphragm 26. This diaphragm 26 is exposed to the refrigerant fluid pressure in the discharge cavity C through an opening 28 in the bottom wall of the housing 12. It should, therefore, be appreciated that the high-pressure switch 24 normally provides an electrically conductive path to the normally grounded compressor from a terminal 34 by which the device 10 is adapted to be connected in the clutch control circuit. When the pressures become sufficiently high so as to be likely to cause damage to the compressor if operation is continued, the contacts 30, 32 are opened (as shown in FIG. 2) and the circuit to the electromagnetic clutch is interrupted. This serves to deenergize the clutch and shut down the operation of the compressor so as to normally provide a high-pressure limit. A further description of the operation of the high-pressure switch 24 will be provided in greater detail below.

Preferably, the pressure-sensing diaphgram 26 may be formed of a durable, synthetic material such as that manufactured under the trademark KAPTON by the E. I. Dupont deNemours Company, Wilmington, Del. The diaphragm 26 is circular and is sealingly clamped about its perimeter against the housing end 20 through a gasket ring 36 by a seal retainer 38. The seal retainer 38 receives its clamping force from a spacer 40 including a downwardly extending circular flange 42 about its periphery. The spacer 40 is held in position within the housing 12 through engagement with a switch support member or bracket 44 and a connecting flange 46 of a non-conductive connector fitting 48 for the electrical terminal 34. As shown, the connector flange 46 is engaged on its outer side by a retaining ring 50 against angularly spaced tangs 52 on the housing 12. These tangs 52 are bent to apply clamping force to the above sandwich arrangement.

As shown in FIG. 1, the pressure sensing diaphragm 26 is connected to a force transmitting assembly 54 including a plunger 56 having a downwardly extending central projection 58. As should be appreciated, the projection 58 is of a smaller diameter than the opening in the seal retainer 38 so as to provide freedom of reciprocating movement of the plunger 56.

The upper surface of the plunger 56 includes a bearing ring 60 that engages a disc spring 62, the spring spanning a central recess in the spacer 40. The upper surface of the disc spring 62 engages at its center an actuator pin 64 of non-conductive material. As shown, the actuator pin 64 extends through a central opening in the spacer 40. The upper surface of the actuator pin 64 engages a rounded projection 66 on a leaf spring 68. The proximal end of the leaf spring 68 is secured by clamping between the connector flange 46 and spacer 40. The contact 30 is mounted to the distal end of the leaf spring 68 and is biased by the leaf spring into engagement with the strip 32 mounted to the switch support member or bracket 44.

Under normal operating conditions, the contacts 30 and 32 remain closed so as to energize the clutch and drive the compressor (see FIG. 1). Once pressures reach a predetermined lower threshold (least extreme high pressure) value, such as a threshold of 450 psig, the contacts 30 and 32 are opened (see FIG. 2). Accordingly, the electromagnetic clutch is disengaged and the drive to the compressor is shut down. Thus, the possible damage to the compressor that could result by operation at these high pressures is normally avoided.

More specifically, as pressures increase to the predetermined lower threshold value, the diaphragm 26 is displaced upwardly in the direction of action arrow A in FIG. 2. As the diaphragm 26 is displaced upwardly, the plunger 56 engaging the diaphragm is also so displaced. As the plunger 56 is displaced, it serves to bear with greater and greater pressure against the disc spring 62 through the bearing ring 60. Once the pressure reaches the predetermined threshold value, the spring 62 is deflected against its built-in bias into the position shown in FIG. 2. To put it another way, the actuating pin 64 is raised in the direction of action arrow A so as to lift the leaf spring 68, and thereby lift the contact 32 from engagement with the contact 30.

Under most operating conditions, the opening of the contacts 30, 32 and the shutting down of the compressor serves to prevent any further rise in pressure within the cylinder of the compressor. Under certain situations, however, the pressure may continue to rise. In the event the pressure rises to a predetermined upper threshold value (e.g. 550 psig), substantially higher than the lower threshold value (450 psig), the high pressure relief valve is activated to rapidly vent the pressurized refrigerant to atmosphere.

This is accomplished by controlled rupturing of the diaphragm 26. More particularly, an array or series of pins 70 may be provided extending around the central opening of the seal retainer 38. These pins 70 extend toward the diaphragm 26 and are positioned so that the diaphragm 26 engages the pins when it is displaced by a refrigerant fluid pressure equal to the upper threshold value. As the diaphragm 26 engages the pins 70, it is punctured and ruptures. The high pressure refrigerant fluid then is vented along the pathway indicated by action arrows B including the passage 72 provided in the spacer 40 and the passage 74 provided in the terminal 34. Upon reaching the terminal 34, the refrigerant is vented to atmosphere as described in greater detail below.

Figure 4:
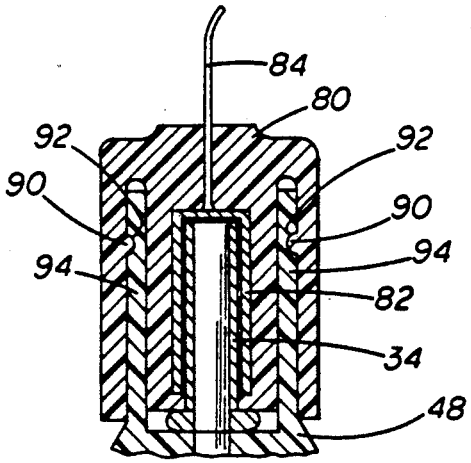
FIG. 4 is a cross-sectional view similar to FIG. 3 showing another embodiment of a blow-off connector.
Figure 3:
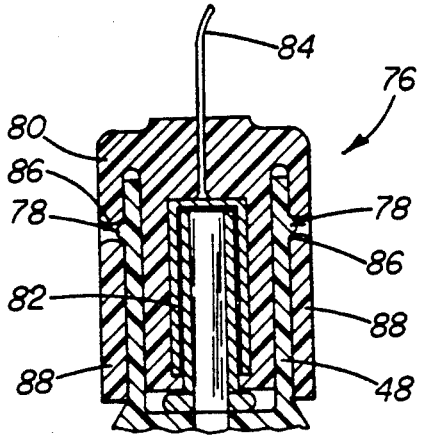
FIG. 3 is a detailed cross-sectional view showing one embodiment of the blow-off connector utilized in the present invention.

More particularly, referring to FIGS. 3 and 4, it should be appreciated that the device 10 of the present invention is equipped with a blow-off connector, generally designated by reference numeral 76. As shown in FIG. 3, the fitting 48 may include a pair of convex dimples 78. A connector cap 80 formed of molded resilient plastic includes a socket 82 designed to engage and make electrical contact with the terminal 34. A lead wire 84 connected to the socket 82 extends from the upper end of the connector cap 80 and electrically connects the switch 24 (i.e. contacts 30, 32) with the electromagnetic clutch control circuit 85.

As should be appreciated, the cap 80 is pressed down over the fitting 48 until the dimples 78 are received in the latch holes 86 positioned in the side walls 88 of the cap. Because of the resilient nature of the sidewalls 88, they snap inwardly over the dimples 78 so as to secure the cap 80 in proper position during normal compressor operation.

In the event the pressure of the refrigerant fluid rises above the predetermined upper threshold pressure value, however, the diaphragm 26 is ruptured as described above. The refrigerant fluid escaping from the compressor cylinder through the passages 72, 74 then presses against the socket 82 and cap 80 with sufficient force to release the dimples 78 from the latch holes 86 and blow the connector cap 80 from the fitting 48. In this way, the compressor cylinder is vented to atmosphere, or to a suitable low pressure accumulator (not shown), and the refrigerant fluid is allowed to escape so as to reduce the cylinder pressure to a non-critical level.

FIG. 4 shows a blow-off connector structure similar to that shown in FIG. 3. In this embodiment, however, the dimples 90 are provided on the connector cap 80. Cooperating concave dimple receiving pockets 92 are formed in the walls 94 of the fitting 48. Thus, as the cap 80 is pressed down over the fitting 48, the dimples 90 are aligned and received in the concave pockets 92 so as to firmly hold the cap 80 in position with the socket 82 in electrical contact with the terminal 34. In the event the diaphragm 26 is ruptured due to high pressure of refrigerant fluid, the cap 80 releases in the manner described above with respect to the embodiment in FIG.

3 so as to allow the refrigerant fluid to escape from the passage 74 and vent to atmosphere.

In summary, numerous benefits have been described which result from employing the concepts of the present invention. The present combination high pressure cut-off switch/high pressure relief valve device 10 provides a substantially simplified and refined structure, for more economical manufacturing, as well as more efficient operation. The new device 10 not only reduces costs, but substantially reduces the potential for refrigerant fluid leaks over previous designs since there are less seal areas With a single diaphragm interface controlling both the upper and lower threshold relief functions. The diaphragm 26 either through selection of proper diaphragm materials and thicknesses, or through the proper positioning of the array of pins 70 allows increased accuracy in setting the upper threshold pressure at which the refrigerant fluid is vented to atmosphere. The device 10 also ensures efficient discharge of refrigerant fluid by the operation in this manner, and fail-safe operation by blow out of the cap 80. This ensures that the original cause of the pressure overload is addressed and corrected thereby providing additional favorable results.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

I claim:

1. A combination high pressure fluid cut-off switch-/high pressure relief valve device, comprising:

a housing mounted in a pressure control installation;

high pressure switch means mounted in said housing;

biasing means urging closing of said high pressure switch;

force transmitting means mounted in said housing having pressure sensing means exposed to pressure to be sensed, said force transmitting means being responsive to high pressure on said pressure sensing means above a lower threshold value to open said high pressure switch means against said biasing means; and means for rupturing said pressure sensing means in response to pressure above an upper threshold value substantially higher than said lower threshold value so as to provide extreme high pressure relief, said rupturing means being mounted in a fixed position at all times during switch operation with respect to said housing and being located adjacent said sensing means.

2. A combination high pressure cut-off switch/high pressure relief valve device for a control circuit to interrupt operation of a fluid compressor or the like, comprising:

a housing mounted in a pressure control installation;

high pressure switch means mounted in said housing;

biasing means urging closing of said high pressure switch;

force transmitting means mounted in said housing having a pressure sensing diaphragm exposed to pressure to be sensed, said force transmitting means being responsive to high pressure on said pressure sensing diaphragm above a lower threshold value to open said high pressure switch means against said biasing means;

means for rupturing said pressure sensing diaphragm in response to pressure above an upper threshold value substantially higher than said lower threshold value, said rupturing means being mounted in a fixed position at all times during switch operation with respect to said housing and being located adjacent said sensing means;

passage means provided within said housing so as to provide a path for said high pressure fluid upon rupture of said pressure sensing diaphragm; and blow-off connector means normally electrically connecting said device to the control circuit, said blow-off connector means remaining locked on said connector in position under normal operation and releasing to allow said connector to blow-off for high pressure relief above said upper threshold value in response to extra high pressure fluid passing through said passage means.

3. A combination high pressure fluid cut-off switch-/high pressure relief device for a control circuit to interrupt operation of a fluid compressor or the like, comprising:

a housing mounted in a pressure control installation;

high pressure switch means mounted in said housing;

biasing means urging closing of said high pressure switch;

force transmitting means mounted in said housing having a pressure sensing diaphragm exposed to pressure to be sensed, said force transmitting means being responsive to high pressure on said pressure sensing diaphragm above a lower threshold value to open said high pressure switch means against said biasing means;

pin means in an array for rupturing said pressure sensing diaphragm in response to pressure above an upper threshold value substantially higher than said lower threshold value, said pin means being mounted in fixed position at all times during switch operation in said housing and being located adjacent said sensing means;

passage means provided within said housing so as to provide a path for said high pressure fluid upon rupture of said pressure sensing diaphragm; and blow-off connector means normally electrically connecting said device to the control circuit, said blow-off connector means including a resilient latch remaining locked on said connector in position under normal operation and releasing and allowing said connector to blow-off for high pressure relief above said upper threshold value in response to extra high pressure fluid passing through said passage means.

* * * * *